US005535907A

United States Patent [19]

Elvin-Jensen

[11] Patent Number: 5,535,907

[45] Date of Patent: Jul. 16, 1996

[54] BINS

[76] Inventor: Flemming Elvin-Jensen, 4655 Woodgreen Drive, West, Vancouver, British Columbia, Canada, V7S 2V4

[21] Appl. No.: 377,082

[22] Filed: Jan. 25, 1995

[51] Int. Cl.[6] ..... B65D 7/00

[52] U.S. Cl. ..... 220/1.5; 220/469; 220/694

[58] Field of Search ..... 220/445, 469, 220/694, 1.5, 628, 636, 694

[56] References Cited

U.S. PATENT DOCUMENTS

| | | | |
|---|---|---|---|
| 4,375,265 | 3/1983 | van de Wetering et al. | 220/1.5 |
| 4,550,849 | 11/1985 | Adsit | 220/1.5 X |
| 4,887,731 | 12/1989 | Pett et al. | 220/1.5 |
| 5,201,432 | 4/1993 | Elvin-Jensen | 220/1.5 |
| 5,251,780 | 10/1993 | Lee | 220/908 X |
| 5,439,113 | 8/1995 | Elvin-Jensen | 220/1.5 X |

*Primary Examiner*—Steven M. Pollard
*Attorney, Agent, or Firm*—Bell, Seltzer, Park & Gibson

[57] ABSTRACT

A bulk container or bin is shown which is used in the storage and long distance transport of materials. The bin is normally moved from location to location by a container ship and for short distance transport, e.g. in a warehouse or the like by a fork lift truck. The bin comprises side walls and a base with a recess or opening in its lower portion below the base, which recess or opening is capable of receiving the "tines" or blades of a fork lift truck fork, there being ribs provided on the underside of the base at the recess and extending in the direction of the recess, the recess having an entrance or mouth at one of the side walls where the height of the ribs is greater than the height of the ribs lying under the major portion of the base. A second wall is provided at the said one side wall at at least close to the entrance to the recess, there being a gap between the two walls, and the ribs extend upwardly to the lower end of the second wall to form an entrance to the opening. Separate wear resistant inserts which are introduced into the gaps between the walls, each with a base that forms a continuation of the ribs there will be adequate protection for the lower edge of the bin should it be struck by the forward edge of the tines of a fork lift truck.

6 Claims, 3 Drawing Sheets

BINS

FIELD OF THE INVENTION

This invention relates to bulk containers or bins.

BACKGROUND OF THE INVENTION

This invention is concerned with a bulk container or bin (hereinafter called "a bin" for convenience) used in the storage and long distance transport of materials, which bin is normally moved from location to location by a transport device, normally a ship, and in particular a container ship, and for short distance transport, e.g. in a warehouse or the like by a fork lift truck. The invention is particularly concerned with such a bin of the kind comprising side walls and a base with a recess or opening in its lower portion below the base, which recess or opening is capable of receiving the "tines" or blades of a fork lift truck fork, there being ribs provided on the underside of the base at the recess and extending in the direction of the recess, the recess having an entrance or mouth at one of the side walls where the height of the ribs is greater than the height of the ribs lying under the major portion of the base. Such a bin is hereinafter called a "bin of the kind set forth".

In particular the invention is concerned with a bin of the kind set forth comprising a second wall at the said one side wall at at least close to the entrance to the recess, there being a gap between the two walls, and the ribs extend upwardly to the lower end of the second wall to form an entrance to the opening. One such bin is that described in my U.S. Pat. No. 5,180,064. Here the inside corners at the joins of the side walls and the base at the opening are of substantial radius (60 to 125 mm) so that the ribs can sweep therearound and there will be a substantial amount of material provided by the ribs to protect the corner of the bin against damage should it be struck by the forward edge of the tines of a fork lift truck. Such a bin has wide application where it is to contain round items such as fruit such as applies and oranges—or vegetables—such as cabbages and lettuce. However the large radius corners limit the usefulness of that bin in transporting right angle cornered items and in particular parallelipipedal items such as boxed product.

I have found that by providing separate wear resistant inserts which are introduced into the gaps between the walls, each with a base that forms a continuation of the ribs there will be adequate protection for the lower edge of the bin should it be struck by the forward edge of the tines of a fork lift truck.

The said second wall may form part of a vertical double wall section. There are preferably single wall sections alternately located between the double wall sections. At the lower ends of these single wall sections there is conveniently an outer wall, which is preferably at the level of the said second wall, the said ribs extending into the space at the lower end of the single wall construction. The inserts must specifically be provided at the double wall sections as it is not possible to provide a practical mould that will result in the ribs running into the gap between the first and second walls.

An embodiment of the invention will now be described by way of example with reference to the accompanying drawings.

SHORT DESCRIPTION OF DRAWINGS

FIG. 1 is a perspective outside view of a detail of a side of a bin of the invention, FIG. 2 is a section on line 2—2 of FIG. 1, FIG. 3 is a detail plan of the side wall of the bin, and FIG. 4 is a section on line 4—4 of FIG. 2.

DESCRIPTION OF PREFERRED EMBODIMENT

Figure 1:
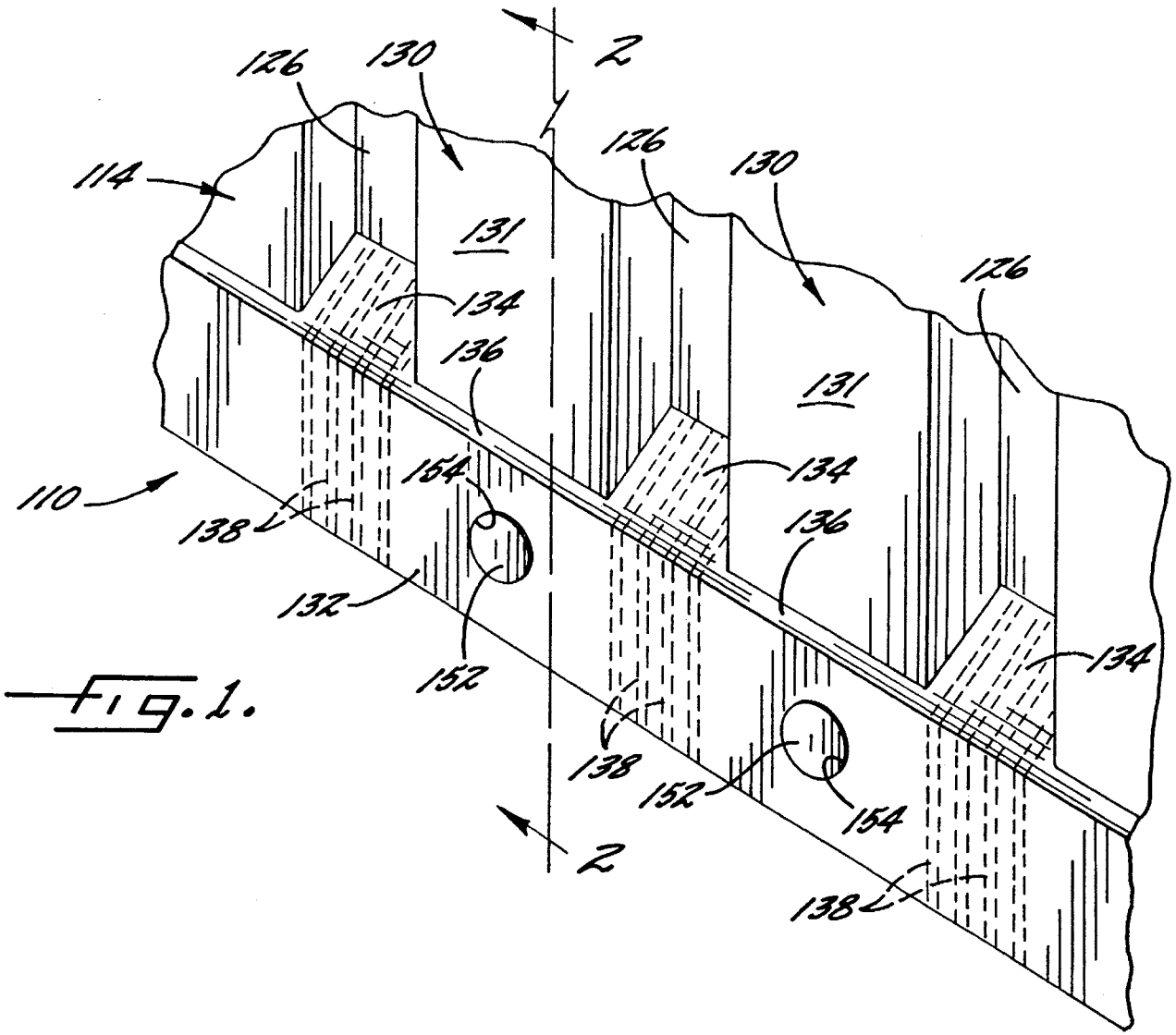
Figure 2:
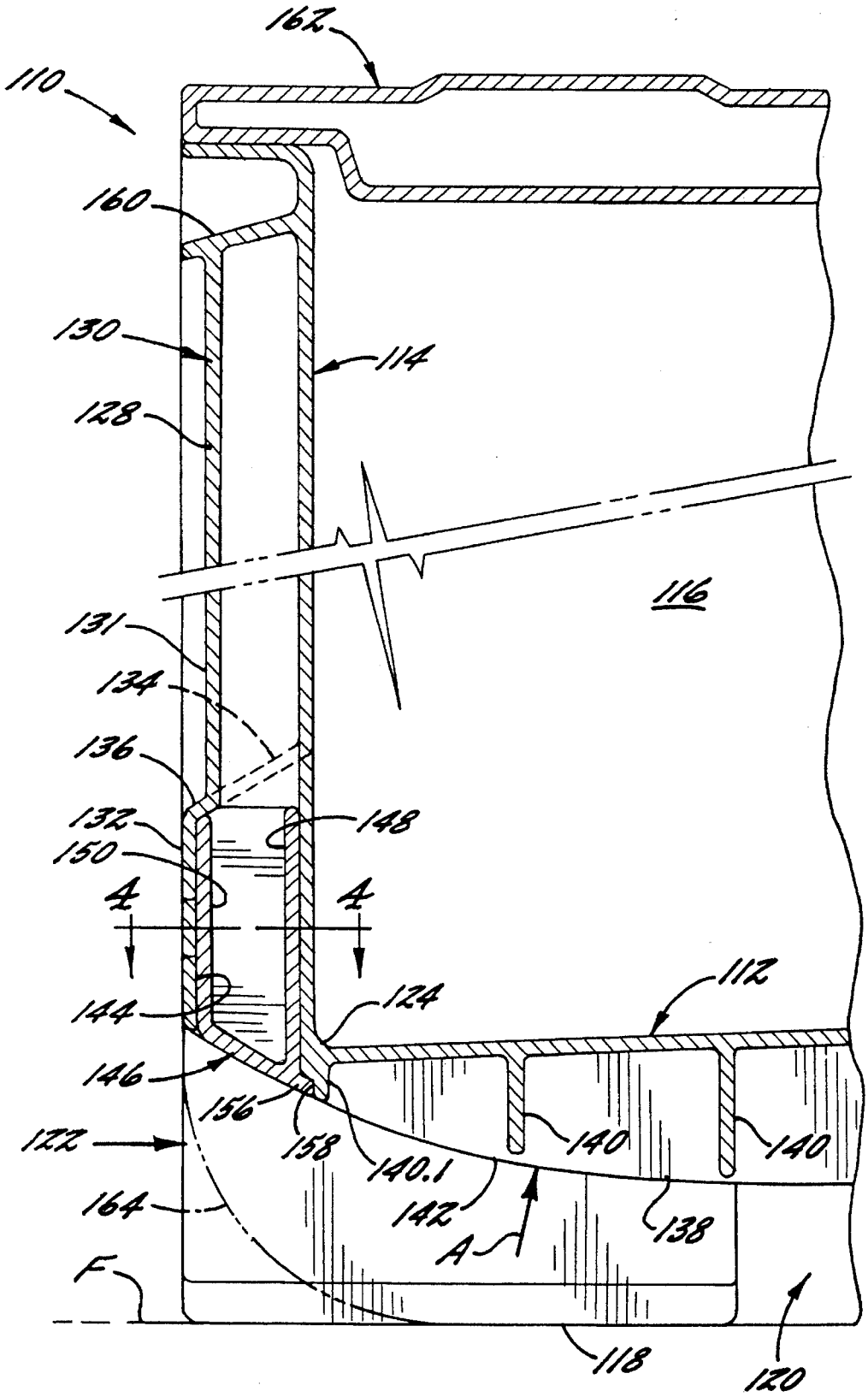
Figure 3:
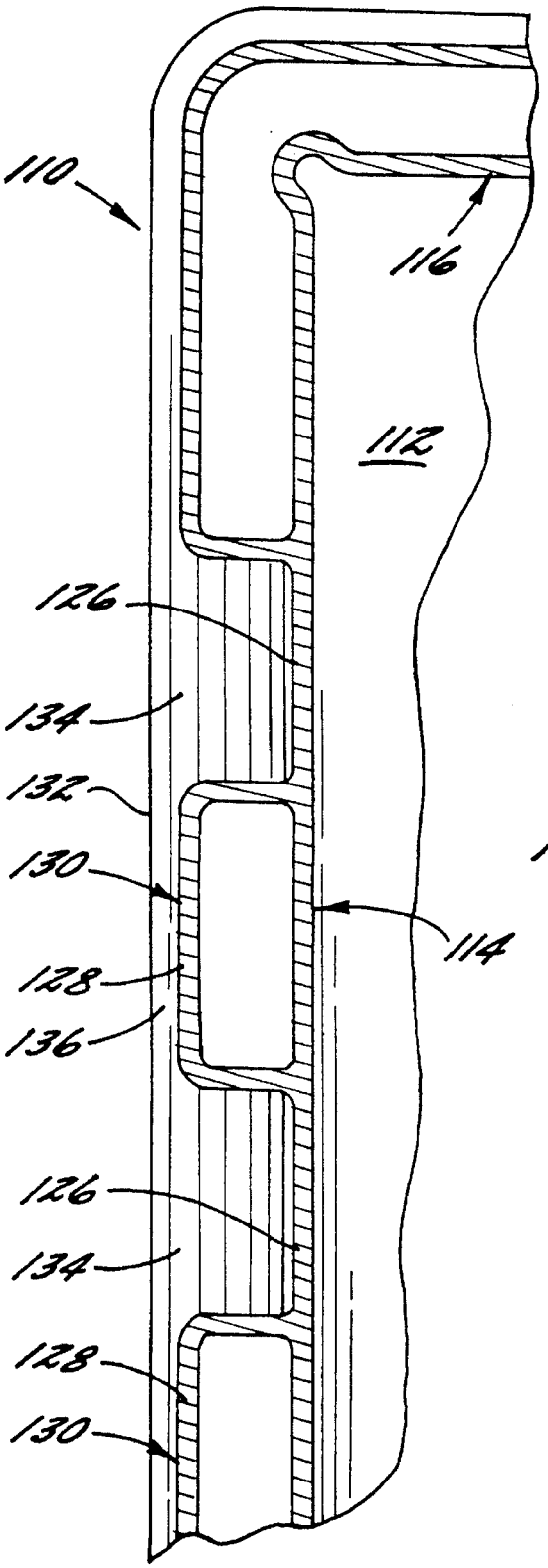

Referring now to the drawings there is shown a bin 110 of the invention which is formed as a plastics moulding, preferably of high density polyethylene. The bin 110 comprises a base 112, side walls 114, end walls 116 and substantially parallelipipedal corner feet 118 on which the bin 110 stands. The feet 118 support the base 112 off the floor or ground surface F whereon the bin is standing to form openings 120 into which the tines of a fork lift truck can enter to support the bin 110. The main entrances 122 to the openings 120 are through the side walls 114 as will be described below.

The end side walls 116 and 114 internally meet the base 112 at a small radius corner 124 of about 5 mm radius.

These walls 114 and 116 are mainly of alternating single and double wall construction 126 and 128, the double wall construction 128 being formed of vertical channel shaped columns 130. Running along the length of the lower portion of each of the walls 114 there is a wall 132 (hereinafter called "the second wall") that lies parallel to and slightly proud of the web 131 of the columns 130. An inclined step 134 leads from the upper edge of the second wall 132 to the single wall portion 126. An aligned but much shorter wall 136 connects the upper portion of the second wall 132 to the webs 131 of the columns 130.

The underside of the base 112 is provided with transverse and longitudinal ribs 138 and 140. Near the entrances 122, the longitudinal ribs 138 sweep upwardly with the undersides 142 of the ribs lying on a 375 mm radius arc A commencing from about the beginning of the feet 118 (where the arc is tangential to the substantially horizontal under sides of the ribs 138 below the major portion of the base 112) and extending to the underside of the second wall 132. The transverse ribs 140 at this opening are of reduced height so as not to project beyond the transverse ribs 138. The outermost longitudinal rib 140.1 is close to the side wall 114 below the base 118. The longitudinal ribs 138 at the single wall sections continue into the spaces 144 between the walls 114 and 132 and merge with the step 134 (the ribs are shown slightly out of scale in FIG. 4). The undersides 142 of these ribs 138 continue to extend along the aforesaid arc A.

A guide plate 146 is provided at the bottom end of each column 130. The guide plate 146 comprises high density polyethylene although it could comprise another high wear-resistant material such as polypropylene. The undersurface of the plate 146 is shaped to lie on the continuation of the arc A on which lie the undersides 142 of the ribs 138. The height of the outermost end portions of the plate 140 and the ribs 130 in the spaces 144 is above the height of both the lower and upper surfaces of the base 112. Thus there is a smooth arcuate surface at the front of the opening defining the entrance 122 to the opening 120 having a height which is significantly larger than (and indeed slightly more than twice) that of the opening below the ribs 138 on the underside of the base 112. In this embodiment, the height of the opening 120 is 38 mm and the height of the entrance 122 is 83 mm).

Figure 4:
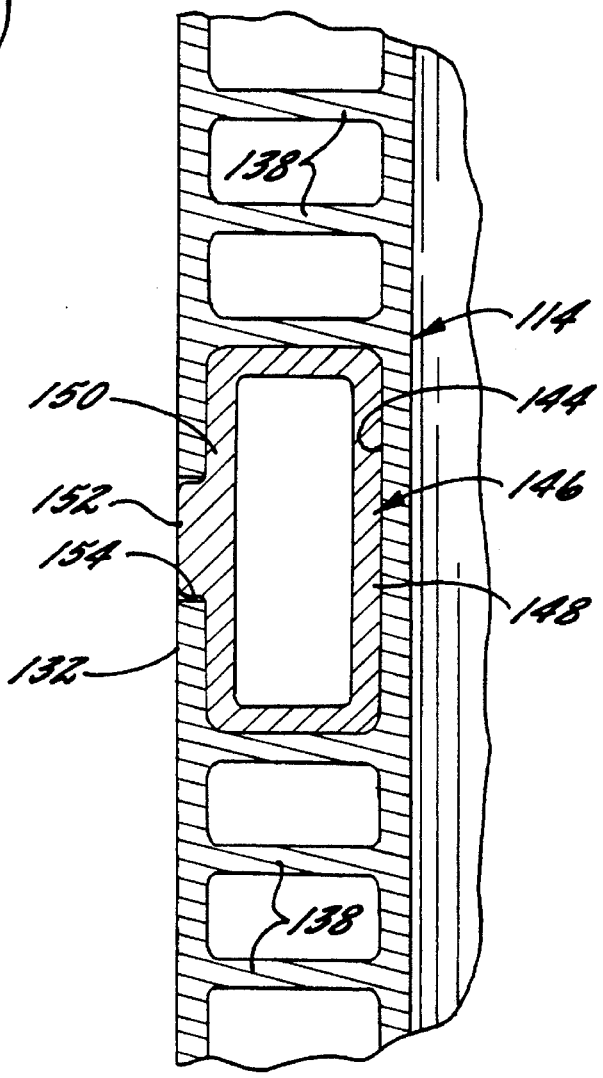

The plate 146 is carried by a hollow rectangular body 148 thereabove that fits tightly into the space 144 at the bottom of the column 130 (as is best shown in FIG. 4). The outer wall 150 of each body 148 has a cylindrical projection 152 which projects through an aperture 154 in the web 131 of the associated column 130 whereby the plate 146 is firmly secured in position. The plate 146 has a short extension 156 adjacent to the inner wall 114. The end of the extension 156 fits firmly in a small recess 158 on the underside of the wall 114.

The base 112 of the bin 110 is internally bowed to a maximum at its centre so that when subject to pressure after having been loaded, it will deflect slightly into a flattened position. The ribs 138 and 140 are deeper at the centre of the bin 110 to maximise the load needed to deflect the base 112.

It will be seen that the smooth arcuate under surface formed by the undersides 142 of the ribs 138 and the plate 146 serves in use to guide the fork lift tines downwardly should these pass into the entrance 122 at its upper portion. Because of the provision of the plate 140, there will be a support for the tines extending over the entire length of the side walls.

The upper portions of the walls may be provided with transverse ribbing 160 so as to reinforce these walls. However, the precise construction can be provided as desired. The bin 110 is provided with a lid 162 which preferably have stacking projections (not shown) that cooperate with recesses (also not shown) in the feet 118 to locate bins firmly one above the other. Means may be provided to secure the lids in position for the physical protection of the contents of the bins or for security purposes.

The bins 110 are of a convenient construction to permit them to be transported in sea containers for use in container ships. The dimensions of the bins 110 are preferably selected so that the optimum volume utilization of the sea container is achieved. To this end, the external dimensions of the bin 110 are conveniently, height: 725 mm, length: 1500 mm; and width: 130 mm. This permits a conventional six meter sea container ( having internal dimensions of height: 2,400 mm; length 6,000 mm; and width: 2,350 mm) to receive twenty four bins 110 stacked snugly therein with enough space to enable the bins to be inserted into the sea container and/or to cope with any indentations or inward projections resulting from the mishandling of the sea container.

The feet 118 of the bin 110 may be modified as indicated in broken lines 164. The outer corners 164 of the feet 118 at one entrance to the opening are of an enlarged radius of between 38 mm to 82 mm and preferably of 75 mm. This will permit the bin to be tipped up on to its side, the bin rolling on the said radiussed corners 164 of the feet, to enable the contents of the bin to be accessible from the side of the bin on removal of the lid.

The invention is not limited to the precise constructional details hereinbefore described and illustrated in the drawings. For example the various dimensions mentioned above may vary as will be apparent to those skilled in the art.

I claim:

1. A bin used in the storage and long distance transport of materials, which bin is normally moved from location to location by a transport device, normally a ship, and in particular a container ship, and for short distance transport, e.g. in a warehouse or the like by a fork lift truck, said bin comprising side walls, a base, a recess or opening in the lower port of the bin below the base, which recess or opening is capable of receiving the "tines" or blades of a fork lift truck fork, said side walls comprising one side wall and a second wall located close to the entrance to the recess, there being a gap between the said second wall and the said one side wall, providing a downwardly facing opening, ribs provided on the underside of the base at the recess and extending in the direction of the recess, the recess having an entrance or mouth at one of the side walls where the height of the ribs is greater than the height of the ribs lying under the major portion of the base, the ribs extending upwardly, to form an arc, from within said recess towards said entrance or mouth, to form an entrance to the opening lower ends of the said one side wall and the second wall, separate wear resistant inserts which are introduced into the gaps, through said openings, between the walls, each said insert comprising a base that forms an arcuate continuation of the ribs.

2. A bin as claimed in claim 1 wherein at least some of the side walls comprising a vertical double wall section.

3. A bin as claimed in claim 2 wherein the side walls which comprise the double wall section also have single wall sections alternately located between the double wall sections.

4. A bin as claimed in claim 1 wherein the insert is carried by a body which is inserted into the said gap.

5. A bin as claimed in claim 1 further comprising feet at the corners of the bin, said feet carrying the bin on a surface and providing the opening below the base of the bin.

6. A bin as claimed in claim 5 wherein the sides of at least some of the feet are radiussed to permit the bin to roll over said radiussed portions whereby the bin can be moved to root on a side wall.

* * * * *